United States Patent [19]

Drechsel

[11] Patent Number: 4,858,829

[45] Date of Patent: Aug. 22, 1989

[54] UNIVERSAL ADVANCEMENT DEFLECTOR FOR IMPACT IRRIGATORS

[76] Inventor: Arno Drechsel, 39, Via Weggenstein - I-39100, Bolzano, Italy

[21] Appl. No.: 582,763

[22] Filed: Feb. 23, 1984

[30] Foreign Application Priority Data

Mar. 18, 1983 [IT] Italy ..... 46825A/83

[51] Int. Cl.[4] ..... B05B 3/02; B05B 3/14

[52] U.S. Cl. ..... 239/230; 239/233; 239/510; 239/513

[58] Field of Search ..... 239/230–233, 239/505, 507, 509, 510, 512, 513, 516, 517

[56] References Cited

U.S. PATENT DOCUMENTS

| | | | |
|---|---|---|---|
| 2,310,796 | 2/1943 | Lappin | 239/231 |
| 2,625,411 | 1/1953 | Unger | 239/233 |
| 2,649,268 | 8/1953 | Stein | 239/233 |
| 3,350,015 | 10/1967 | Friedmann et al. | 239/233 |
| 3,986,671 | 10/1976 | Nugent | 239/233 |
| 4,231,522 | 11/1980 | Drechsel | 239/233 |

*Primary Examiner*—Joseph F. Peters, Jr.
*Assistant Examiner*—James M. Kannofsky
*Attorney, Agent, or Firm*—Birch, Stewart, Kolasch & Birch

[57] ABSTRACT

A universal advancement deflector for impact irrigators, comprising a cylindrical surface portion (15) pivoted about an axis (11) spaced from its barycenter, and urged towards the irrigation jet so that it becomes inserted therein with one of its edges and its longitudinal axis disposed respectively tangentially and orthogonally to said jet, so that it inclines in order to provide a reaction component which causes it to emerge from the jet; the load which the surface (15) presents to the jet and its rocking range being adjustable.

5 Claims, 2 Drawing Sheets

UNIVERSAL ADVANCEMENT DEFLECTOR FOR IMPACT IRRIGATORS

BACKGROUND OF THE INVENTION

1. Field of the Invention

The present invention relates to so-called "impact" irrigators, in which a rocker arm cyclically moves a deflector in front of the jet, the deflector interfering with the water flow to generate, by reaction, a tangential impulse which causes the rotation of the irrigator to advance through one step. More particularly, the invention relates to said deflector devices disposed at the end of the rocker arm.

2. Description of the Prior Art

In known devices, when the deflectors enter the water jet, their action is very sudden, this leading to jolting and vibration which often compromise the rigidity of the irrigator.

In this respect, this latter is disposed in nearly all cases at the top of a column, which is kept vertical by a tripod driven into the ground.

Because of the fact that the ground rapidly becomes impregnated with water, it offers a very precarious support, thus requiring an irrigator which is of smooth operation, free from violent jolting and thus also free from vibration.

Finally, there is the need for a deflector which, although operating free from jolting or vibration, functions properly without the need for adjustment.

In known deflectors, the adjustment is made by varying the angle of incidence between the flat reaction surface of the deflector and the jet axis, but this procedure creates problems particularly when the angle of incidence has to exceed a determined value, for example when operation at low pressure is required. Lastly, there is no known deflector able to operate satisfactorily on one and the same irrigator for a wide range of nozzle diameters and at different pressures.

SUMMARY OF THE INVENTION

The object of the present invention is to provide a jet deflector device for fitting to the end of the rocker arm of impact irrigators. which is of progressive and smooth operation, is able to function when associated with a wide range of nozzles of different diameter and within a wide pressure range, starting from a comparatively low pressure of the order of 2.5 atm., and is able to deviate the jet into fan form at minimum pressure, i.e. at the instant of start-up and stoppage of the system, so as to prevent furrow formation in the ground.

This object is attained according to the invention by a deflector constituted substantially by a cylindrical surface which subtends a right angle, is disposed with its axis substantially orthogonal to the jet, and rocks about an axis spaced from its barycenter or center of mass.

According to the invention, said surface is inserted into the jet by way of an edge thereof which is tangential to the jet, and is kept in position either elastically or by means of a counter-weight, so that by inclining under the action of said jet, it offers a reaction component which causes it to emerge from the jet. The force that keeps the surface in position, and the amplitude of its rocking movements about its pivotal axis, can obviously be adjusted from the outside, but once adjusted they require no re-adjustment over a wide range of operating situations.

BRIEF DESCRIPTION OF THE DRAWINGS

The constructional merits and characteristics of the invention will be more apparent from the detailed description given hereinafter with reference to the figures of the accompanying drawings, which illustrate a preferred embodiment thereof by way of non-limiting example.

Figure 1:
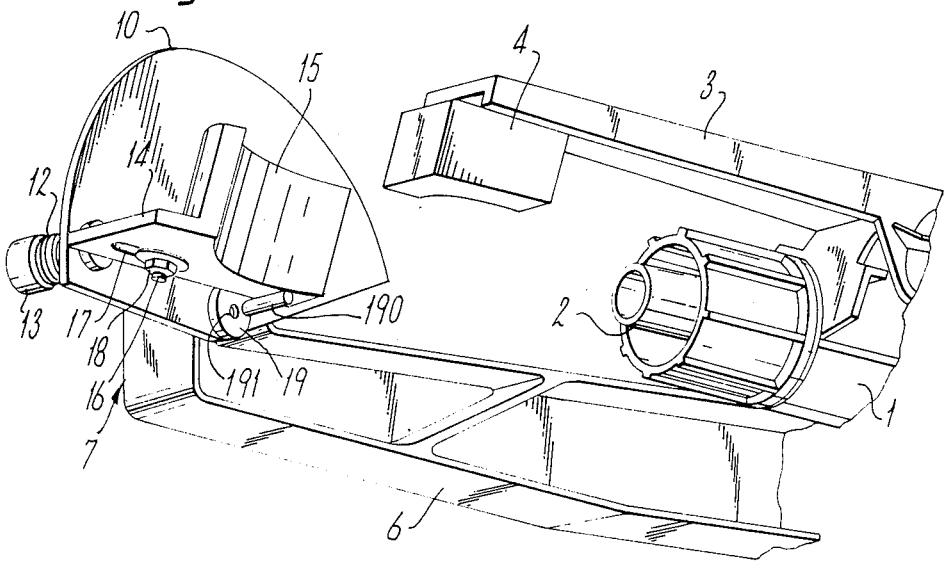
FIG. 1 is a perspective view of the front end of an impact irrigator equipped with the invention.

Said figures show a normal propelling tube 1 provided with a nosepiece 2, and designed to be disposed by way of an adjustable brake at the top of an irrigation water feed column.

To the propelling tube 1 there is upperly pivoted a rocker lever 3 provided with a deflector 4 for the rapid return of the propelling tube 1, of known type.

Said lever 3 comprises a stepped cam 5 arranged to rest on the nozzle of the nosepiece 2 when the deflector 4 has sunk into the jet, in order to regulate the degree of immersion of the deflector 4 into the jet in accordance with the operating pressure. This is made possible by the fact that the rocker lever 3 is mounted slidable on its own pivotal shaft by way of a convenient elastic repositioning member.

Figure 3:
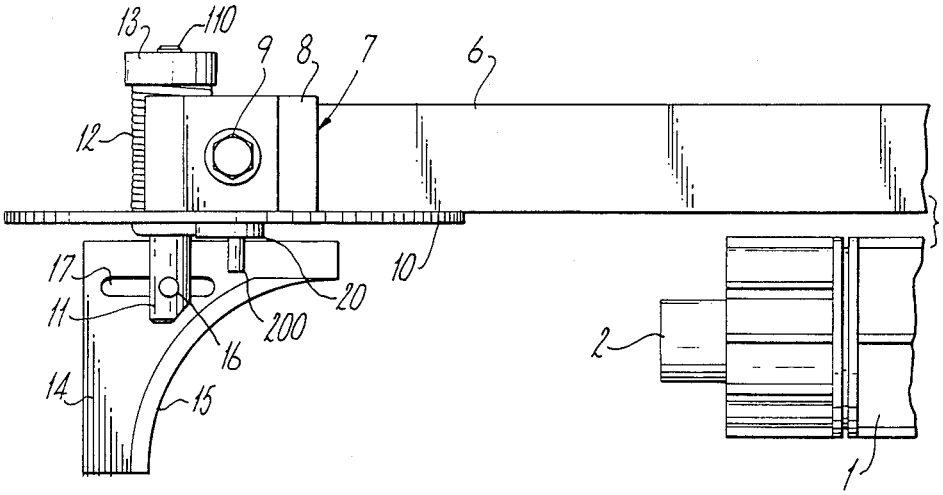
FIG. 3 is a plan projection of the invention.
Figure 4:
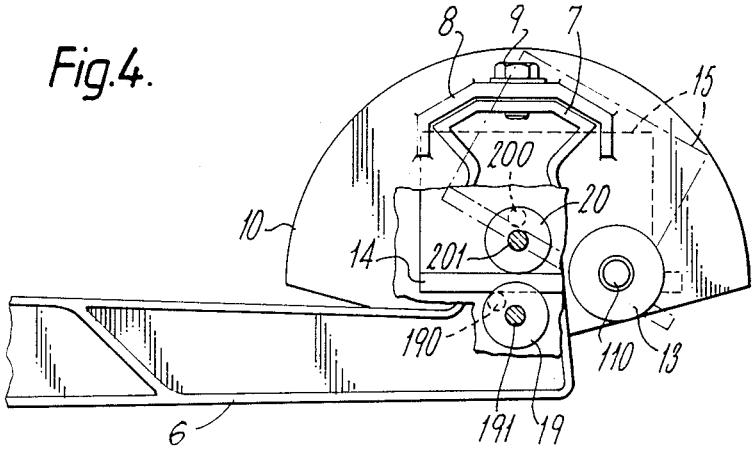
FIG. 4 is an opposing side view thereof.

A rocker arm 6 is also pivoted to said propelling tube 1 to be able to rock in a vertical plane, and is provided at its front with a salient head 7 (FIG. 4) to which a profiled plate 10 is fixed parallel to the rocker arm 6 by means of a rear connection bracket 8 and a respective locking screw 9 (FIGS. 3 and 4).

On that side of the plate 10 which faces away from the nozzle 2 there is idly mounted a pin 11 on which, on the same side as the rocker arm 6, there is mounted a torsion spring 12, the opposing ends of which are fixed to the plate 10 and to a torsional force adjustment ring 13 which is screwed on to a threaded end portion 110 of the pin 11.

The deflector 15 can be urged towards the jet by means of an adjustable counter-weight.

The other end of the pin 11 lowerly supports a profiled ledge 14 from which there rises a deflector 15, and which is locked by means of a transverse screw 16 (FIG. 3) which is fixed to the pin 11, and passes through a slot 17 in the ledge 14 in order to receive a locking nut 18 (FIG. 1). The slot 17 enables the distance between the deflector 15 and the nosepiece 2 to be adjusted in accordance with the irrigator throughput and pressure.

Figure 2:
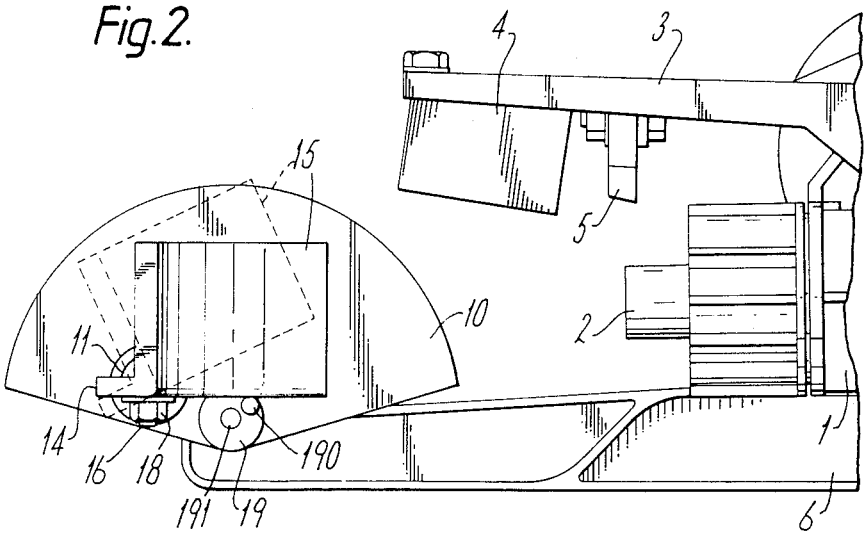
FIG. 2 is a side view of the preceding figure.

The deflector 15, which is arranged for cyclic insertion into the jet in order to rotate the propelling tube 1 stepwise, is constituted by a cylindrical wall which subtends an angle of 90° (FIG. 3), its longitudinal axis being orthogonal to that of the jet (FIGS. 2 and 3), its inlet edge being tangential to said jet (FIG. 3), and it outlet edge being at the opposite end of the plate 10. On the active face of the plate 10 on the side corresponding to the nosepiece 2 there are two discs, namely a lower 19 and an upper 20, provided with respective eccentric pegs 190 and 200, which are fixed to the plate 10 by corresponding screws 191 and 201 which enable them to be adjusted angularly. The pegs 190 and 200 act as end-of-stroke stops for the rocking movement of the deflector 15.

When the deflector 15 penetrates into the jet it inclines forwards as shown, against the action of the spring 12 or counter-weight, so that on the one hand the impact with the jet is made more smooth or soft, and on the other hand a surface is offered which provides a downward reaction.

Two orthogonal forces thus act on the deflector by virtue of the reaction to the jet impact, one of these causing the propelling tube 1 to rotate through one step about the column, whereas the other causes the rocker arm 6 to emerge from the jet.

On emerging from the jet, the deflector returns to its previous position, and the successive operating cycles are an identical repetition of the aforesaid.

The illustrated deflector operates below the jet, but it is apparent that it can be mounted in such a manner as to operate above the jet. Furthermore, the deflector 15 can be disposed on an arm which rocks in a horizontal plane, with its pivotal pin 11 disposed vertically.

At this point it will be apparent that the invention attains all the stated objects by virtue of the predetermined, minimum and necessary, immersion of the deflector into the jet, and by virtue of its continuous self-adjustment.

It should also be noted that the deflector 15 can be rigidly fixed to the pin 11, and the distance of this latter from the nosepiece 2 can be adjusted by providing a suitable slot in the plate 10.

Moreover, the rocking range of the ledge 14 can be selected by means of two lugs rigid with the plate 10, each provided with an adjustable screw.

In addition, the elastic force which urges the deflector towards the jet can be provided by an adjustable tension spring disposed in front of the deflector 15, on by an adjustable compression spring disposed behind the deflector 15.

The invention is not limited to the single embodiments heretofore described, and modifications and improvements can be made thereto but without leaving the scope of the inventive idea, the basic characteristics of which are summarised in the following claims.

I claim:

1. A universal advancement deflector for an impact irrigator having a rocker arm (6) disposed on a propelling tube (1) with an outlet nosepiece (2) providing a jet, said universal advancement deflector comprising a member having a barycenter and having a cylindrical surface (15) which substends a substantially right angle, said cylindrical surface terminates in edges and is formed around a longitudinal axis, a pin (11) mounted on said rocker arm, said member being pivoted about said pin at a location spaced from said barycenter, adjustable repositioning means (12) for opposing the movement of said member being caused by said cylindrical surface being arranged to penetrate into said jet such that one of said edges and said longitudinal axis are respectively tangential and orthogonal to said jet so that under the action of said jet said surface inclines in order to provide a reaction component which causes said surface to emerge from the jet, adjustment means (19,190) (20,200) for selecting the rocking range of said cylindrical surface, means (17, 18) for adjusting the distance of said cylindrical surface from said outlet nosepiece, and said cylindrical surface (15) comprises an outer end ledge (14) fixed to said pin (11) and said pin is pivoted in a plate (10) disposed on said rocker arm (6).

2. A universal advancement deflector for an impact irrigator having a rocker arm (6) disposed on a propelling tube (1) with an outlet nosepiece (2) providing a jet, said universal advancement deflector comprising a member having a barycenter and having a cylindrical surface (15) which substends a substantially right angle, said cylindrical surface terminates in edges and is formed around a longitudinal axis, a pin (11) mounted on said rocker arm, said member being pivoted about said pin at a location spaced from said barycenter, adjustable repositioning means (12) for opposing the movement of said member being caused by said cylindrical surface being arranged to penetrate into said jet such that one of said edges and said longitudinal axis are respectively tangential and orthogonal to said jet so that under the action of said jet said surface inclines in order to provide a reaction component which causes said surface to emerge from the jet, adjustment means (19,190) (20,200) for selecting the rocking range of said cylindrical surface, means (17, 18) for adjusting the distance of said cylindrical surface from said outlet nosepiece, and said means for adjusting the distance between said cylindrical surface (15) and said nosepiece (2) comprise a slot (17) provided in a ledge (14) and receiving a screw (16, 18) which is fixed into said pin (11).

3. A universal advancement deflector for an impact irrigator having a rocker arm (6) disposed on a propelling tube (1) with an outlet nosepiece (2) providing a jet, said universal advancement deflector comprising a member having a barycenter and having a cylindrical surface (15) which substends a substantially right angle, said cylindrical surface terminates in edges and is formed around a longitudinal axis, a pin (11) mounted on said rocker arm, said member being pivoted about said pin at a location spaced from said barycenter, adjustable repositioning means (12) for opposing the movement of said member being caused by said cylindrical surface being arranged to penetrate into said jet such that one of said edges of said longitudinal axis are respectively tangential and orthogonal to said jet so that under the action of said jet said surface inclines in order to provide a reaction component which causes said surface to emerge from the jet, adjustment means (19,190) (20,200) for selecting the rocking range of said cylindrical surface, means (17, 18) for adjusting the distance of said cylindrical surface from said outlet nosepiece, and said means (17, 18) for adjusting the distance between said cylindrical surface (15) and said nosepiece (2) comprise a slot provided in a ledge (10) to adjustably receive said pin (11).

4. A universal advancement deflector for an impact irrigator having a rocker arm (6) disposed on a propelling tube (1) with an outlet nosepiece (2) providing a jet, said universal advancement deflector comprising a member having a barycenter and having a cylindrical surface (15) which subtends a substantially right angle, said cylindrical surface terminates in edges and is formed around a longitudinal axis, a pin mounted on said rocket arm, said member being pivoted about said pin at a location spaced from said barycenter, adjustable repositioning means (12) for opposing the movement of said member being caused by said cylindrical surface being arranged to penetrate into said jet such that one of said edges and said longitudinal axis are respectively tangential and orthogonal to said jet so that under the action of said jet said surface inclines in order to provide a reaction component which causes said surface to emerge from the jet, means (17, 18) for adjusting the distance of said cylindrical surface from said outlet nosepiece, and adjustment means (19, 190) (20, 200) for selecting the rocking range of said cylindrical surface comprising two angularly adjustable eccentric pegs (190, 200) disposed on a plate (10) located on said rocker arm (6) and straddling an outer ledge (14) of said cylindrical surface (15).

5. A universal advancement deflector for an impact irrigator having a rocker arm (6) disposed on a propelling tube (1) with an outlet nosepiece (2) providing a jet, said universal advancement deflector comprising a member having a barycenter and having a cylindrical surface (15) which subtends a substantially right angle, said cylindrical surface terminates in edges and is formed around a longitudinal axis, a pin mounted on said rocker arm, said member being pivoted about said pin at a location spaced from said barycenter, adjustable repositioning means (12) for opposing the movement of said member being caused by said cylindrical surface being arranged to penetrate into said jet such that one of said edges and said longitudinal axis are respectively tangential and orthogonal to said jet so that under the action of said jet said surface inclines in order to provide a reaction component which causes said surface to emerge from the jet, means (17, 18) for adjusting the distance of said cylindrical surface from said outlet nosepiece, and adjustment means (19, 190) (20, 200) for selecting the rocking range of said cylindrical surface comprising two orthogonal lugs extending from a plate (10) located on said rocker arm (6), said lugs straddle a ledge (14) of said cylindrical surface (15), and each said lug comprises an adjustable locating screw.

* * * * *